US006004626A

United States Patent [19]

Noone et al.

[11] Patent Number: 6,004,626

[45] Date of Patent: Dec. 21, 1999

[54] HIGH PRESSURE/VOLUME PROCESS FOR WET SHOTCRETING A REFRACTORY CASTABLE

[75] Inventors: Kenneth Noone, Medina, Ohio; Samuel B. Bonsall, III, State College, Pa.

[73] Assignee: North American Refractories Co., Cleveland, Ohio

[21] Appl. No.: 09/113,411

[22] Filed: Jul. 10, 1998

[51] Int. Cl.[6] ..... B05D 1/02

[52] U.S. Cl. ..... 427/421; 427/427

[58] Field of Search ..... 427/421, 427

[56] References Cited

U.S. PATENT DOCUMENTS

| | | | |
|---|---|---|---|
| 4,262,055 | 4/1981 | Russell et al. | 427/372.2 |
| 4,327,185 | 4/1982 | Bonsall | 501/89 |
| 4,444,593 | 4/1984 | Schutz | 106/692 |
| 4,780,142 | 10/1988 | Rechter | 501/133 |
| 5,512,325 | 4/1996 | Langenohl et al. | 427/421 |

*Primary Examiner*—Shrive Beck
*Assistant Examiner*—Bret Chen
*Attorney, Agent, or Firm*—Mark Kusner

[57] ABSTRACT

A method of applying a refractory castable onto a surface of a refractory structure, comprising the steps of: [a)] preparing a thoroughly mixed wet castable for application onto a surface of a refractory structure; [b)] conveying the wet-mixed refractory castable at a set rate under pressure through a delivery hose having a predetermined cross-sectional area to a dispensing device having an air inlet and a dispensing nozzle; [c)] introducing air under pressure into the dispensing device, wherein the air pressure ranges from about 20 psi to about 80 psi and wherein the air has a velocity of about 177 ft/sec at 20 psi and an air velocity of about 484 ft/sec at 80 psi and wherein the velocity increases by about 5 ft/sec for every unit increase in the pressure.

1 Claim, 1 Drawing Sheet

HIGH PRESSURE/VOLUME PROCESS FOR WET SHOTCRETING A REFRACTORY CASTABLE

FIELD OF THE INVENTION

The present invention relates generally to shotcreting installations and processes, and more particularly, to a method for wet-mix spraying of refractory castables.

BACKGROUND OF THE INVENTION

In recent years, refractory shotcreting has become an important process for lining, repairing and maintaining refractory linings in steel, non-ferrous metal, chemical, mineral and ceramic processing plants. Shotcreting is usually classified according to the process used, i.e., wet-mix or dry-mix spraying. A dry-mix refractory shotcrete process generally consists of conveying a dry or slightly dampened refractory material through a delivery hose by compressed air to a nozzle where water is introduced to wet the mix prior to application of the refractory material onto a surface. A dry-mix refractory shotcrete process involves transport of the refractory material by large volumes of compressed air. As the result, the velocity of the mix striking the target surface is very high giving good compaction.

A wet-mix refractory shotcrete process generally consists of thoroughly mixing a refractory material and water to produce a pumpable mixture, then introducing the mixture into a delivery hose and pumping the mixture to a dispensing (i.e., spraying) device. A wet-mix process has several advantages over the dry-mix process. For example, a wet-mix process uses materials that do not include clay that may adversely affect the refractoriness of the material. Another is that the refractory materials are more thoroughly mixed with specific amounts of water before the material is conveyed through a dispensing hose to the dispensing nozzle. The thorough mixing of measured amounts of water gives more consistent properties to the refractory mix. A further advantage of a wet-mix process is that less dust is generated during the spraying process. Further, less skill and judgment are required by the nozzle operator compared to a dry-mix process. In this respect, the nozzle operator need only direct the stream as compared to constantly adjusting the water input and directing the stream in a dry-mix process.

Heretofore, because of the inherent weight involved in pumping a wet refractory mix through a delivery hose and the difficulty of maneuvering the same, most delivery hoses are generally 1½ inch to 2 inches in diameter. In a wet-mix process, air is provided at the nozzle to project the wet-mix refractory onto the surface to be lined. Conventionally, the air lines to the dispensing nozzle are typically ⅜ inch to ½ inch. In this respect, compared to a dry-mix process, far less air is used in a wet-mix process. Typically, air is introduced into a standard wet-process nozzle by means of a ⅜ inch or ½ inch standard pipe. Air is injected into the refractory in a wet-mix nozzle as a propellant and to break the refractory into a spray (a set modifying admixture is typically introduced into the refractory material at this time). A rubber nozzle tip is used to focus the spray stream of refractory material to establish both a suitable velocity and spray pattern.

The velocity of the refractory material as well as the separation of refractory material within the air stream is based, in part, upon the operating pressure of the air source. Typically, in most factory settings, the air pressure may vary from 60 psi to 100 psi.

Aside from the refractory material used, several factors affect the quality of the applied refractory material. Foremost among the influential factors are the rate of flow of the refractory material into the nozzle, and the airflow to the nozzle to break the refractory into globules of particulate to be sprayed.

The present invention provides an improved method of wet-mix shotcrete spraying, wherein airflow to the dispensing nozzle is increased and an enlarged mixing chamber is provided to break up the refractory material into finer particulate for spraying in a higher velocity stream.

SUMMARY OF THE INVENTION

In accordance with the present invention, there is provided a method of applying a refractory castable onto a surface of a refractory structure. The method is comprised of preparing a thoroughly mixed wet refractory castable for application onto a surface or refractory structure; conveying the wet-mix refractory castable at a fixed rate under pressure through a delivery hose of predetermined cross-sectional area to a dispensing device having an air inlet and a dispensing nozzle introducing air under pressure into the dispensing device, wherein said air pressure ranges from about 20 psi to about 80 psi, and wherein air has a velocity of about 177 ft/s at 20 psi and an air velocity of about 484 ft/s at 80 psi, and wherein the velocity increases by about 5 ft/s for every unit increase in air pressure.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
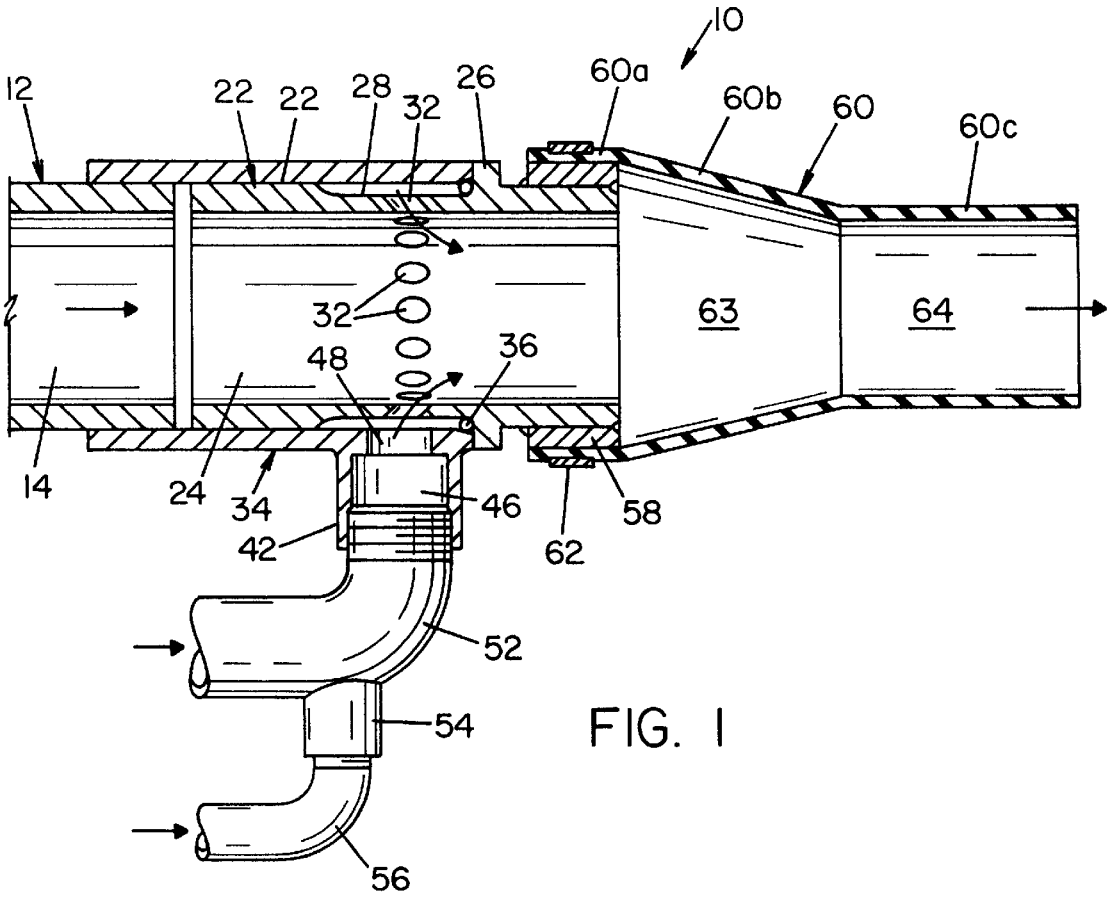
FIG. 1 is a sectional view of a refractory dispensing nozzle illustrating a preferred embodiment of the present invention.

Referring now to the drawings wherein the showings are for the purpose of illustrating the preferred embodiment of the invention only, and not for the purpose of limiting same, FIG. 1 shows a refractory dispensing device 10 for spraying refractory material. Dispensing device 10 is adapted for attachment to a delivery hose, the end of which is shown in FIG. 1 and designated 12. Delivery hose 12 is generally cylindrical in shape and defines a cylindrical passage 14 therethrough for conveying wetted refractory material from a pressurized source (not shown) to refractory dispensing device 10.

Dispensing device 10 is generally comprised of a cylindrical body 20 having an outer cylindrical surface 22. A bore 24 is defined within cylindrical body 20 and is dimensioned to be in alignment with, and generally correspond to, passage 14 defined in the delivery hose 12. Body 20 includes an outwardly extending, annular flange 26. An annular recess 28 is formed within outer surface 22 of body 20. A plurality of apertures 32 extend through the wall of body 20 and communicate recess 28 with inner bore 24. A cylindrical sleeve 34 is dimensioned to enclose the end of delivery hose 12 and one end of body 20. Sleeve 34 has an inner diameter dimensioned to mate with and match the outer diameter of body 20. An annular O-ring or seal 36 is provided where sleeve 34 abuts flange 26 to form a seal therebetween. Sleeve 34 includes a nipple 42 having internal threads. Nipple 42 defines a cylindrical cavity 46. A bore 48 extending through the wall of sleeve 34 to communicate with cavity 46 within nipple 42 with recess 28. Nipple 42 and bore 48 are disposed on sleeve 34 such that when sleeve 34 abuts flange 26 of body 20, bore 48 is in registry with recess 28 and apertures 32.

In accordance with the present invention, nipple 42 is preferably dimensioned to receive a conventional pipe elbow 52 as illustrated in the drawings. Elbow 52 is dimensioned for attachment to an air source (not shown) for conveying pressurized air into fluid dispensing assembly 10. In accordance with one aspect of the present invention, elbow 52 is at least a ¾" standard steel pipe elbow. Elbow 52 itself includes a bushing 54 that is threaded to receive a smaller elbow 56. Smaller elbow 56 is adapted for connection to a pressurized source (not shown) of a set modifying admixture which will mix with the air injected into dispensing device 10. A cylindrical sleeve 58 is attached to the end of body 20 to increase the diameter thereof.

A nozzle 60 is attached to the free end of body 20. Nozzle 60 includes a first cylindrical portion 60*a* dimensioned to receive the free end of body 20, a tapered or conical portion 60*b* and a smaller second cylindrical portion 60*c*. First portion 60*a* of nozzle 60 attached to sleeve 58 on body 20 by means of a conventional hose clamp 62. Nozzle 20 defines a generally conical mixing cavity 62 and a cylindrical refractory-directing orifice 64. Nozzle 60 is dimensioned to be attached onto sleeve 58. In this respect, nozzle 60 is oversized and is larger than conventional nozzles that would normally be used and be attached to body 20.

The operation of the present invention shall now be further described by way of contrasting the operation of dispensing device 10 against a conventional dispensing device. In accordance with the present invention, dispensing device 10 provides increased air velocity at the tip of the nozzle using conventional back pressures.

TABLE I lists typical back pressures and the corresponding nozzle tip velocities of air produced by a conventional dispensing devices and produced by dispensing device 10 (referred to hereinafter at times as the "modified nozzle") of the present invention.

TABLE I

| BACK PRESSURE (psi) | AIR VELOCITY-STANDARD NOZZLE (ft/s) | AIR VELOCITY-MODIFIED NOZZLE (ft/s) |
|---|---|---|
| 20 | 135 | 177 |
| 30 | 179 | 235 |
| 40 | 216 | 288 |
| 50 | 251 | 333 |
| 60 | 291 | 380 |
| 70 | 333 | 434 |
| 80 | 367 | 484 |

In accordance with the present invention, for every unit increase in air pressure applied to dispensing device 10 through elbow 52, there is about a five (5) unit increase in air velocity at the tip of nozzle 60. For every unit increase in the applied pressure to the unmodified nozzle, there is only about a four (4) unit increase in the air velocity at the tip of nozzle 60.

Table I shows that at 80 psi, the velocity of the air at the tip of the modified device is about 30% greater than the air velocity at the tip of the unmodified shotcreting dispensing device. The greater the velocity of the air at the nozzle tip the greater the velocity of the refractory therefrom and greater the compaction of the refractory on the surface to be lined. In this respect, the refractory is sprayed from nozzle 60 in the form of "droplets" or "particles" of refractory material. The compaction of the refractory castable droplets against a surface is proportional to the kinetic energy at impact. Since the kinetic energy is proportional to the square of the velocity, the increase in kinetic energy is about 70% because of the 30% increase in air velocity. That is:

$$V^2_{modified}/V^2_{standard}=(1.3)^2/(1)^2=1.69 \text{ or about } 70\%.$$

This increase in kinetic leads to greater compaction of the refractory castable which leads to a higher density of the cured refractory, a lower porosity of the cured refractory, improved strength of the cured refractory and improved abrasion of the cured refractory.

A test is conducted to compare the effects of spray refractory castables with a dispensing device 10 in accordance with the present invention against conventionally known dispensing devices. TABLE II sets forth the mix formulations for two (2) different refractory materials.

TABLE II

REFRACTORY MIX FORMULATIONS

| Raw Material | Particle Size (Tyler Mesh) | Refractory Mix 1 (% wt) | Refractory Mix 2 (% wt) |
|---|---|---|---|
| 60% Alumina Grain, sized fractions | 4 mesh & finer | 63.75% | |
| Calcined Clay Aggregate (40-50% Alumina), sized fractions | 4 mesh & finer | | 65.00% |
| Raw Kyanite | −35 mesh | 1.25% | |
| Raw Kyanite | −325 mesh | 14.00% | 15.00% |
| Fine Alumina | −325 mesh | 11.00% | 6.00% |
| Microsilica | | 6.00% | 6.00% |
| Calcium Aluminate Cement | | 4.00% | 8.00% |
| Dispersant, Condensed Sulfonated Naphthalene Salt | | 0.15% | 0.15% |
| Polypropylene fibers | | 0.08% | 0.08% |
| Set Retarder, citric acid | | 0.10% | 0.20% |
| TOTAL | | 100.33% | 100.43% |

Both refractory mixes are applied using dispensing device 10 and a conventional dispensing device.

TABLE III shows the difference in physical properties of the two formulations set forth in TABLE II. In TABLE III, a dispensing device 10 in accordance with the present invention is identified as "new," and a conventional dispensing device is identified as "standard."

TABLE III

PROPERTIES OF WET-PROCESS SPRAYED MIXES

| | Refractory Mix 1 | | | Refractory Mix 2 | | |
|---|---|---|---|---|---|---|
| Water Addition, % | 7.1 | | | 7.3 | | |
| Accelerator | 1 gal. Water in 1 gal. sodium silicate | | | | | |
| Admixture Rate | 1.8 gal/ton | | | | | |
| Nozzle | Standard | New | Difference (New-Std) | Standard | New | Difference (New-Std) |
| Porosity, % | | | | | | |
| 230° F. | 18.9 | 18.4 | −0.5 | 17.6 | 16.5 | −1.1 |
| 1500° F. | 21.5 | 20.6 | −0.9 | 20.9 | 20.7 | −0.2 |
| Density, g/cm$^3$ | | | | | | |
| 230° F. | 2.41 | 2.42 | 0.01 | 2.33 | 2.35 | 0.02 |
| 1500° F. | 2.36 | 2.40 | 0.04 | 2.30 | 2.33 | 0.03 |
| Cold Crushing Strength, psi | | | | | | |
| 230° F. | 3400 | 4700 | 1300 | 5700 | 5900 | 200 |
| 1500° F. | 4150 | 4500 | 350 | 4500 | 7250 | 2750 |
| Abrasion Test, Volume Loss, cm$^3$ | | | | | | |
| 230° F. | 19.8 | 9.3 | −10.5 | 8.5 | 4.3 | −4.2 |
| 1500° F. | 22.8 | 12.2 | −10.6 | 13.5 | 11.1 | −2.4 |

TABLE III shows a slight decrease in porosity of the cured refractory mixes as deposited with the "new" modified nozzle design of the present invention. A slight increase in density of the cured refractory is also shown. Most notable is the increase in cold crushing strength and the decrease in volume loss as experienced in conventional abrasion testing.

The present invention thus provides a dispensing device for wet shotcreting a refractory castable that results in: (1) improved compaction of the refractory castable leading to a higher density of the final, cured refractory; (2) a lower porosity of the final, cured refractory; (3) improved strength of the final, cured refractory; (4) improved abrasion of the cured refractory; and, (5) the ability to more evenly sprayed the refractory castable than known heretofore.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A method of applying a refractory castable onto a surface of a refractory structure, comprising the steps of:

a) preparing a thoroughly mixed wet refractory castable for application onto a surface of a refractory structure;

b) conveying the wet-mixed refractory castable at a set rate under pressure through a delivery hose having a predetermined cross-sectional area to a dispensing device having an air inlet defined by at least a ¾" standard pipe and a dispensing nozzle having a dispensing nozzle opening;

c) introducing air under pressure into said dispensing device, wherein said air pressure ranges from about 20 psi to about 80 psi, said nozzle opening in said dispensing nozzle being sized in relation to said air inlet such that said air through said nozzle opening has a velocity of about 177 ft/sec at 20 psi and an air velocity of about 484 ft/sec at 80 psi and wherein said velocity increases by about 5 ft/sec for every unit increase in said air pressure to apply the refractory castable onto the surface of the refractory structure.

* * * * *